US006790166B2

(12) United States Patent
Broudy

(10) Patent No.: US 6,790,166 B2
(45) Date of Patent: Sep. 14, 2004

(54) BALANCE AND COORDINATION TEACHING METHOD

(76) Inventor: Jack Broudy, 121 Grandview, Leucadia, CA (US) 92023

( * ) Notice: Subject to any disclaimer, the term of this patent is extended or adjusted under 35 U.S.C. 154(b) by 209 days.

(21) Appl. No.: 10/068,042

(22) Filed: Feb. 5, 2002

(65) Prior Publication Data

US 2002/0128133 A1 Sep. 12, 2002

Related U.S. Application Data

(63) Continuation-in-part of application No. 09/164,975, filed on Oct. 1, 1998, now abandoned.

(51) Int. Cl.[7] ..... A63B 22/14

(52) U.S. Cl. ..... 482/147; 482/34; 482/79; 482/148; 482/907; 473/415; 473/459; 473/524; 473/131; 273/108.1; 273/108.2; 434/252; D21/791

(58) Field of Search ..... 482/147, 34, 79, 482/148, 907; 473/415, 459, 524, 131; 273/108.1, 108.2; 434/252; D21/791

(56) References Cited

U.S. PATENT DOCUMENTS 3,441,271 A 4/1969 Palacios ..... 272/33
4,300,282 A 11/1981 Bunyea et al. ..... 272/146
5,067,710 A 11/1991 Watterson et al. ..... 272/129
5,879,275 A * 3/1999 Aruin ..... 482/146

* cited by examiner

*Primary Examiner*—Nicholas D. Lucchesi
*Assistant Examiner*—L. Amerson
(74) *Attorney, Agent, or Firm*—Stetina Brunda Garred & Brucker

(57) ABSTRACT

A method for improving balance and coordination associated with the performance of a sport motion. The method comprises the initial step of providing a training apparatus, the latter comprising a stationary base member having first and second platforms rotationally mounted. The first and second are adapted to receive, respectively, a foot of an individual to enable the individual to stand thereon such that each foot can rotate independently about a separate axis. While standing upon the device, an individual may perform a variety of movements, such as a tennis stroke, golf swing, and the like, and, by virtue of imparting rotational movement to the feet, enable an individual to optimally perform proper rotational movements. The training method maybe incorporated into a sports instruction regimen applicable to a wide-variety of sports, including skiing, surfing, and martial arts, as well as many activities, in addition to tennis, golf and baseball.

6 Claims, 9 Drawing Sheets

BALANCE AND COORDINATION TEACHING METHOD

CROSS REFERENCE RELATED APPLICATION

The present application is a continuation-in-part patent application of U.S. patent application Ser. No. 10/068,041 filed Feb. 5, 2002, now abandoned, which was a continuation patent application of Ser. No. 09/164,975 filed Oct. 1, 1998, now abandoned, which was a continuation-in-part of Design Pat. Application Ser. No. 29/093,801, filed Sep. 18, 1998, and issued as U.S. Design Pat. 415,224, on Oct. 12, 1999.

BACKGROUND OF THE INVENTION

To excel in sports, it is necessary for one to possess not only strength and stamina, but balance and coordination as well. Indeed, virtually every sport places demands on its participants to move and contort the body in ways in which it is generally not accustomed. Perhaps the most challenging of these movements include proper rotation of the body (i.e., rotation of the shoulders, back and torso relative to the legs), in conjunction with shifting one's weight from one leg to another that must accompany such movement, in anticipation of or in reaction to a given event. For example, a baseball player making a swinging motion with a bat in response to a pitch, a golfer making a swing, or a tennis player hitting either a serve, forehand or backhand shot must properly rotate and balance the body during such action. Each such sport requires the proper timing of shifting and rotation, such that at the moment of impact, the athlete's weight and stroking motion will drive the ball in a desired manner and preferably to a desired location. Further examples can be found in the sports of skiing and surfing which require participants to properly rotate and balance the body so that the center of gravity of the person is properly maintained in response to the size and contour of a slope or wave.

Numerous devices and methods are known in the art for developing strength and stamina. Typically, trainers direct athletes to utilize free weights or weight machines to strengthen specific muscles or muscle groups. For stamina, athletes are typically directed to utilize stationary machines such as treadmills, stair climbers, rowing machines, and stationary bicycles.

While generally effective at facilitating the development of cardiovascular endurance by increasing the heart rate, lung capacity, etc., such devices are generally linear in nature and cause the user thereof to engage in a single repetitious activity oriented toward making a forward motion. In this regard, none of the aforementioned classes of cardiovascular exercise equipment place any emphasis on rotational movement, let alone develop the balance and coordination that typically must accompany such movement.

To address such need, trainers have traditionally taught proper rotation and weight shifting without the assistance of special equipment by (1) instructing and demonstrating to a person a body movement (i.e., tennis stroke, golf stroke, etc.) to be acquired, (2) observing the person mimic the trainer's instructions/demonstration, (3) providing feedback to the person (e.g., by videotape), and (4) repeating the cycle until the person has acquired the desired level of coordination and balance. Initially, such instruction typically includes a step by step list of specific body movements that attempt to impart on the person the mechanics of balance and coordination associated with such body movement. To accomplish this task, the trainer will explain the proper mechanics of balance and coordination associated with each body movement. However, the person typically just mimics the trainer's body movements without the proper mechanics of balance and coordination, which thus produces sub-optimal results because although the person thinks the body is moving as instructed, in actuality it is not. In this regard, the difficulty of learning the mechanics of balance and coordination associated with a body movement is due to the fact that such movements are not natural movements, but rather are movements only performed within the realm of a specific sport which the person is trying to learn.

Compounding the difficulties in instructing the proper mechanics of balance and coordination for a given sport is that a person is instructed to practice such body movements while standing on stable ground. However, stable ground allows a person to compensate an unbalanced and uncoordinated movement without any awareness as to which aspect of the body movement needs to be modified to achieve optimal balance and coordination. Typically, after the person fails to improve his or her balance and coordination, the instructor, trainer or coach further instructs that person to continue practicing the body movement hoping the person will improve. The instructor, etc. fails to understand, however, that balance and coordination of a person cannot be improved by merely instructing the person to improve; rather, the person needs to isolate the balance and coordination component of the body movement to improve one's balance, such that a person may have instantaneous feedback when the movements are not balanced and coordinated.

For the foregoing reasons, there is a need for a method of teaching the mechanics of balance and coordination such that a person may experience proper balance and coordination during the performance of a body movement. There is additionally a need in the art for method of teaching the mechanics of balance and coordination that can be incorporated into sports instruction, and in particular the instruction of tennis, golf, and the like, to better improve upon an athlete's performance. There is yet further a need in the art for such a method that is safe and easy to implement, utilizes minimal, low-cost equipment, can be utilized to improve an athlete's performance of any of a wide variety of sports and can be practiced both indoors and outdoors year-around.

SUMMARY OF THE INVENTION

The present invention specifically addresses and alleviates the above-identified deficiencies in the art. In this regard, the present invention is directed to an improved teaching method for developing balance and coordination.

The initial step of the method comprises providing an apparatus, the latter comprising: 1) a stationary base member positionable upon a planar surface; 2) a first platform surface rotatably mounted upon the base member, the first platform surface being formed to rotate about a first axis; and 3) a second platform surface rotatably mounted upon the base member, the second platform surface being formed to rotate about a second axis. After being provided the apparatus, the person mounts the same by placing each foot on a respective one of the first and second platform surfaces. The person may practice body movements, such as tennis ground strokes and golf swings, that include a "figure 8" pattern of movement of the person's hips. To achieve such motion, an individual stands upon the device such that one foot is received upon the first platform surface and the respective other upon the second platform surface. While in such position, the knees and elbows are comfortably bent with the arms extended out in front of the individual. The individual then slowly turns his or her feet from the left to right to the left again such that the hips engage in a rotational movement simulating a figure eight pattern. In this respect, the body movements mimic a substantial "cork-screw" movement up and down. As should be appreciated, the invention is not limited to tennis ground strokes and golf swings; rather, these are merely examples of body movements in specific sports where the "figure 8" pattern of hips is inherent.

The process further preferably is applied to improve a person's balance and coordination for a given motion by conveying information to a person about a body movement in conjunction with the apparatus, as discussed above, wherein the body movement includes the "figure 8" movement of the person's hips. Such movement is specifically incorporated into any of a variety of motions inherent for a given sport. For example, almost every sport requires the proper "form" and such form is generally initiated at the hips. Specifically, the "figure eight" movement is incorporated as part of a tennis stroke, and in particular, a forehand, backhand and/or serve, a golf swing, a baseball bat swing, and the like and is practiced as part of performing a given motion.

To that end, the information generated from such usage maybe conveyed to a person through a pre-recorded medium such as a video or audio tape or through live instruction. Furthermore, the trainer may observe the person perform the exercise on the apparatus, then provide constructive feedback to further improve the person's balance and coordination. In this regard, the apparatus, when used to perform a given stroke or movement, may be integrated into an instruction or training regimen to improve a given individual's ability to play a particular sport, and more particularly, to perform the movements and strokes of a given sport with greater proficiency.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

The detailed description set forth below in connection with the appended drawing is intended merely as a description of the presently preferred embodiment of the invention, and is not intended to represent the only steps in which the present invention may be practiced. The description sets forth the steps of the method to implement the invention in connection with the illustrated embodiment. It is understood, however, that equivalent steps may be performed that are also intended to be encompassed within the spirit and scope of the invention.

Figure 1:
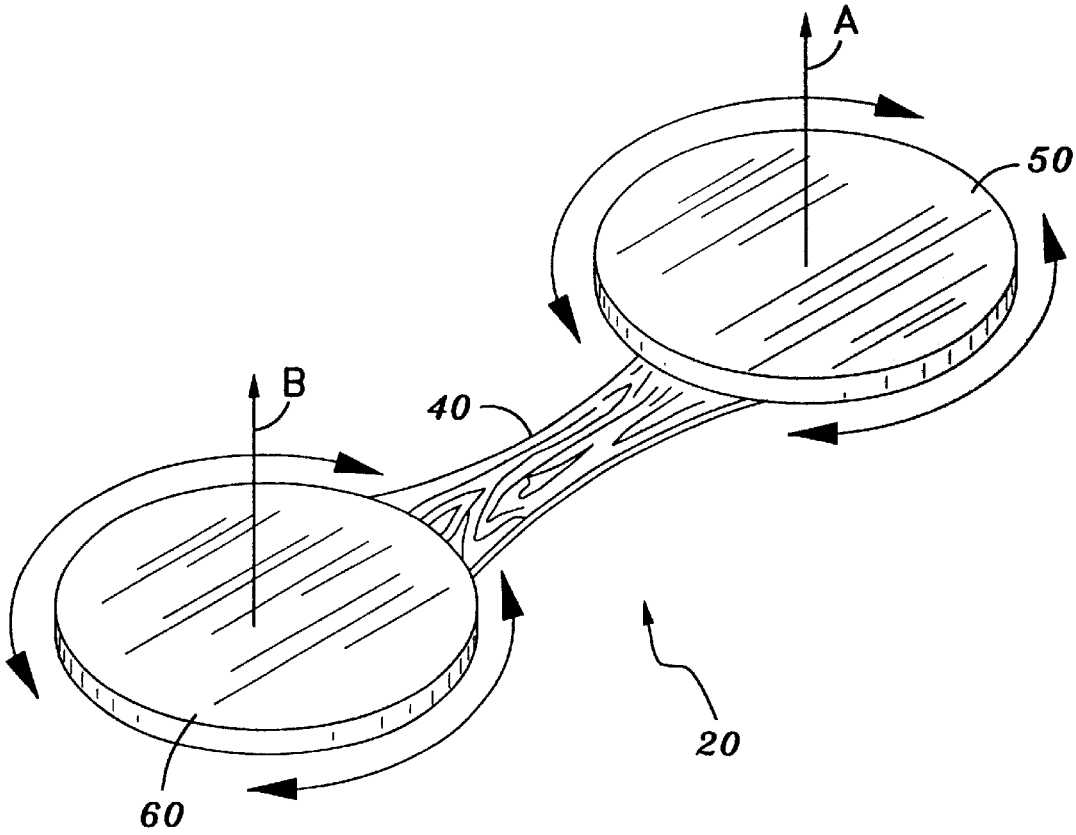
FIG. 1 is a perspective view of an apparatus used in the practice of the methods of the present invention.

Referring now to FIG. 1, there is depicted an apparatus 20 for use in the practice of the methods of the present invention. Such apparatus 20 consists of 1) a stationary base member 40 positionable upon a planar surface, 2) a first platform surface 50 rotatably mounted upon the base member 40, the first platform surface 50 being formed to rotate about a first axis A; and 3) a second platform surface 60 rotatably mounted upon the base member 40, the second platform surface being formed to rotate about a second axis B.

Figure 2:
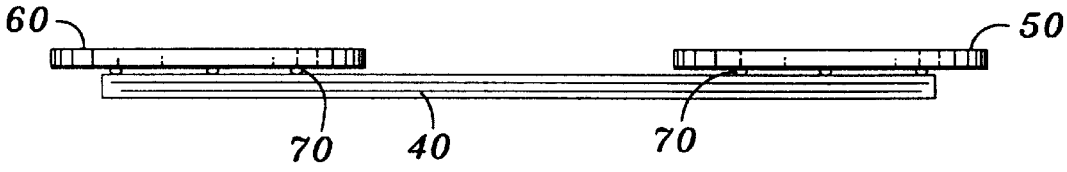
FIG. 2 is a side-view of the apparatus depicted in FIG. 1.
Figure 3:
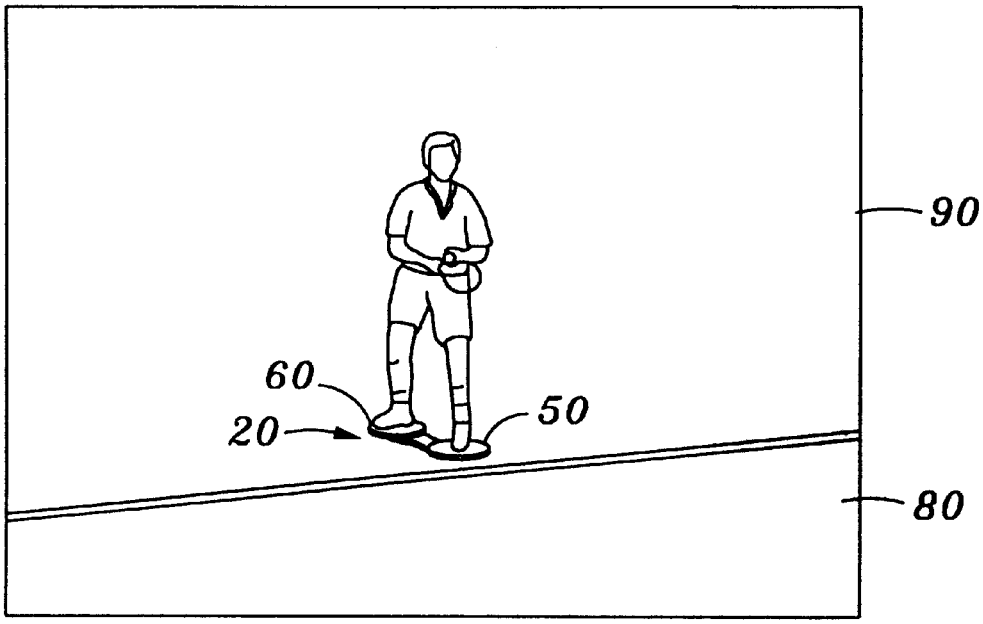
FIG. 3 is a photograph of an individual initiating service of a tennis ball while standing upon the device depicted in FIG. 1.
Figure 4:
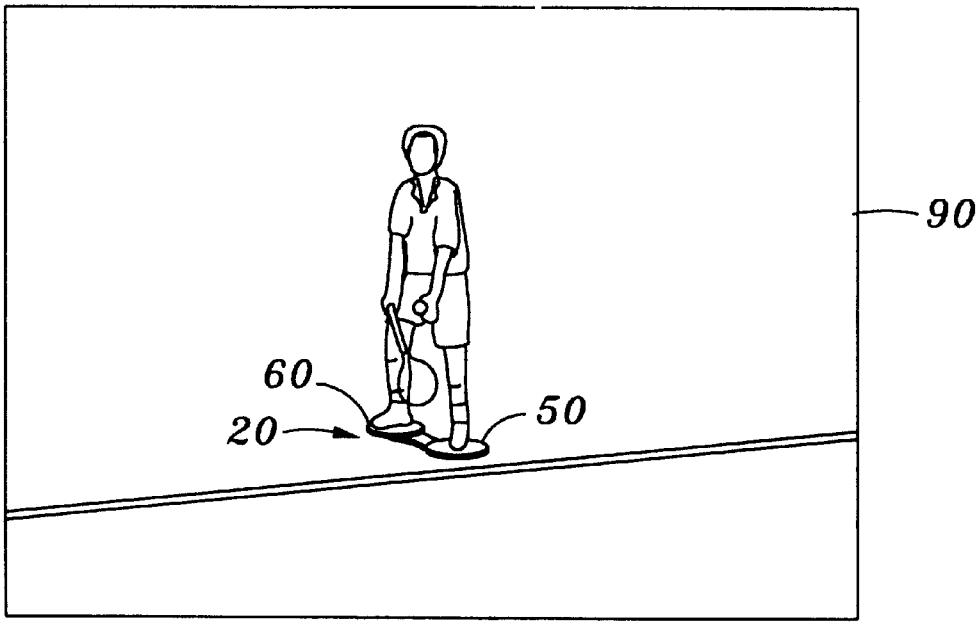
FIG. 4 is a photograph of the individual standing upon the apparatus commencing the toss of a tennis ball for service.
Figure 5:
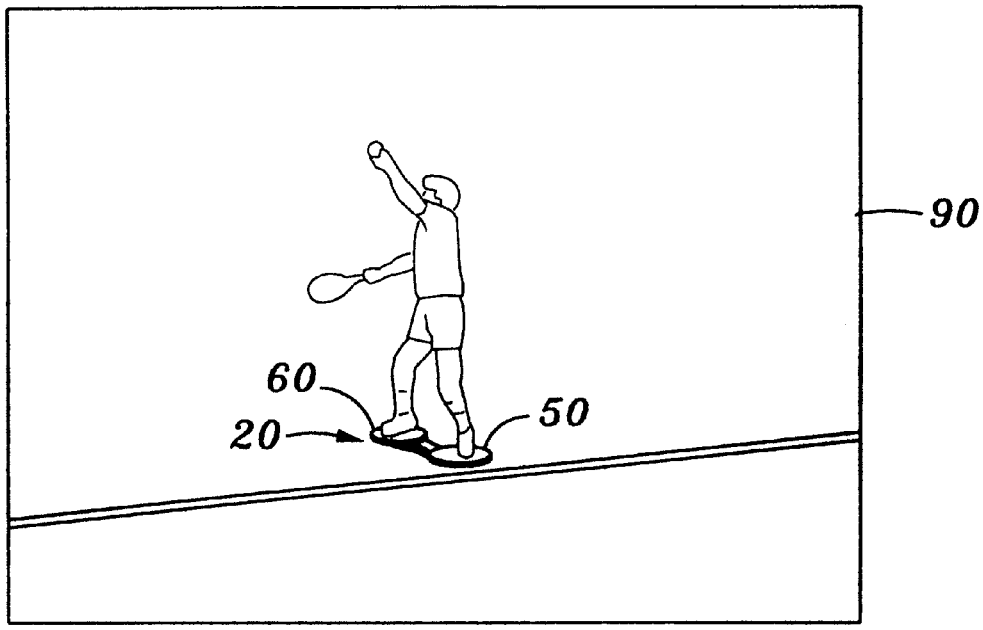
FIG. 5 is a photograph of the individual standing upon the apparatus initiating the back swing of the service motion.
Figure 6:
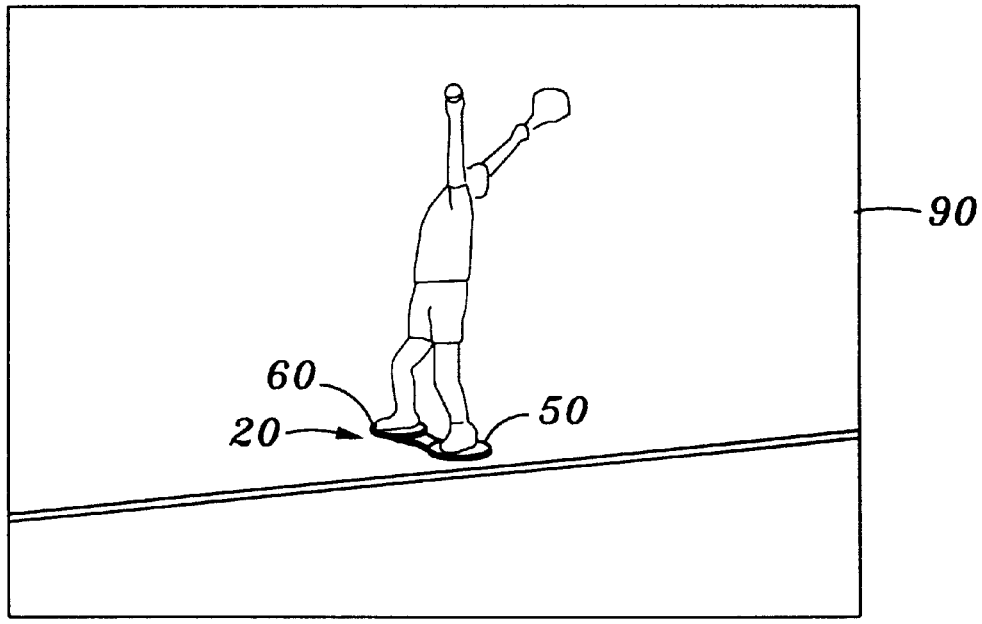
FIG. 6 is a photograph of the individual upon the apparatus having completed the toss motion and poised to serve the ball.

To achieve that end, both first and second platforms 50, 60 will be mounted upon ball bearings, such as 70, depicted in FIG. 2. In this regard, such rotational mounting of the first and second platform surfaces 50, 60 upon base 40 may take any of a variety of forms well-known in the art that can enable such surfaces to rotate in the manner shown.

The first platform surface 50 and second platform surface 60 are configured to receive a respective one of the feet of an individual, to thus enable an individual to stand thereon. More specifically, the first platform surface 50 will receive one foot of an individual and second platform surface 60 will receive the second foot of the individual. Each foot of the individual, however, will be independently free to rotate about the respective axes to thus enable an individual to swivel thereon. As will be appreciated by those skilled in the art, both first and second platform surfaces 50, 60 maybe provided with a texturized surface to more securely receive a foot positioned thereon.

In a most preferred embodiment, the apparatus depicted in FIGS. 1 and 2 takes the form of the 8 BOARD™ exercise devices produced by Grail Sports, Inc., of Leucadia, Calif. Such product is further depicted at the website of Grail Sports, Inc., namely, http://grailsports.com, the teachings of which are expressly incorporated herein by reference.

Referring now to FIGS. 3–10, a method of improving the balance and coordination of a tennis player making a service motion is depicted. The apparatus 20, as discussed above, is placed on a tennis court 80. The person will mount the apparatus by placing one foot on the first platform surface 50 and the other on the second platform surface 60 while just behind the baseline 100 and facing the net.

As depicted in FIGS. 3–6, the individual 90 makes a service toss and positions his body to strike the ball, as per the conventional service motion well-known in the art. Such conventional service motion, however, is made while the individual 90 stands on the apparatus 20 of the present invention. As a result, the individual's feet are free to rotate about the respective axes about which the first platform member 50, and second platform 60 rotate. Advantageously, as has not heretofor been available, the ability of the user's feet to rotate while initiating such service motion imparts to the individual 90 the ideally body positioning, balance, and leg and hip rotational movement that is optimally made during the service motion.

Figure 7:
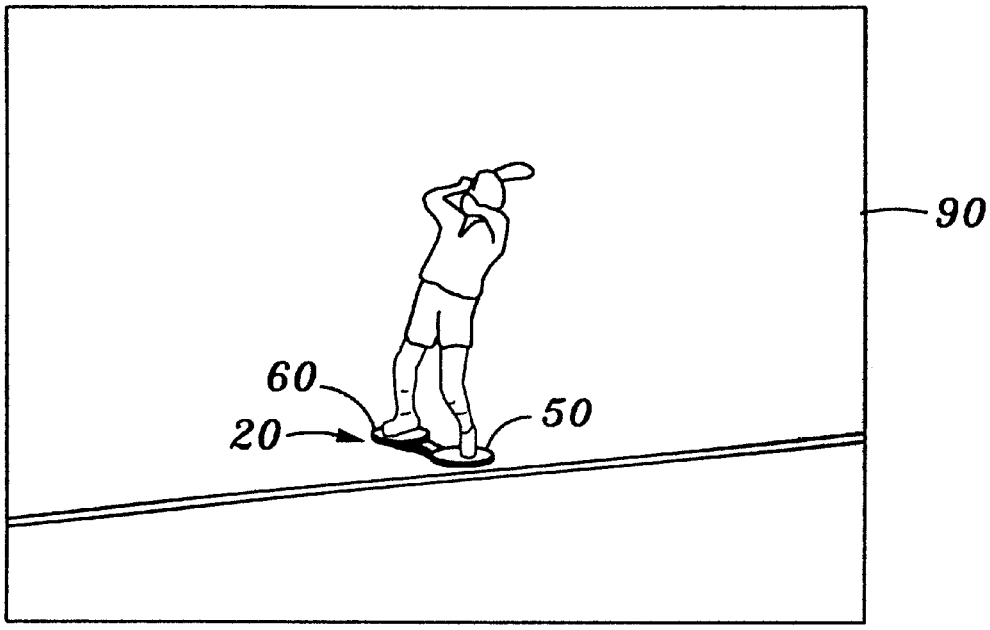
FIG. 7 is a photograph of the individual on the apparatus proceeding to strike the ball.
Figure 8:
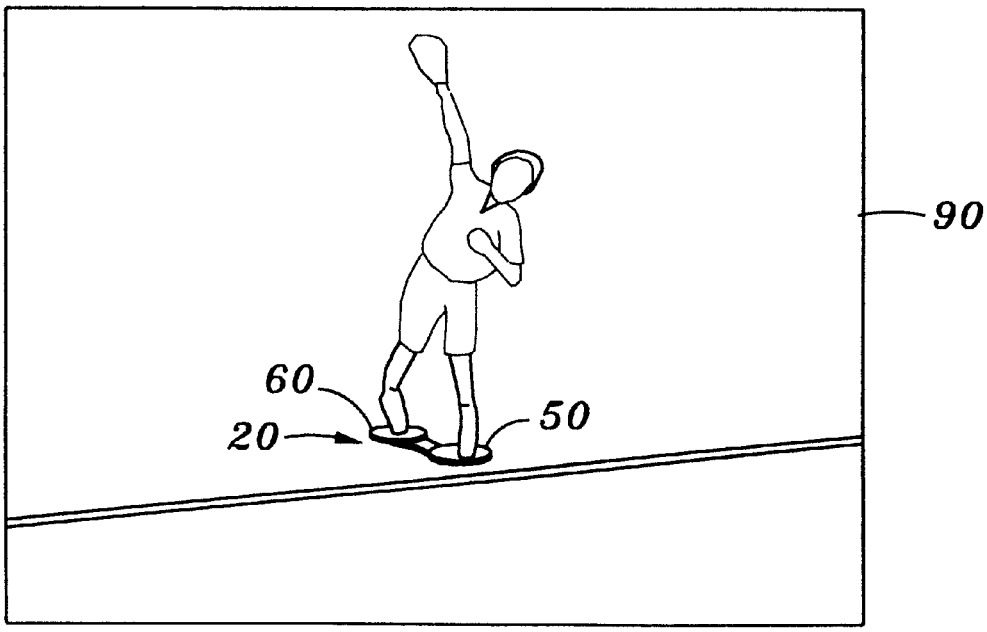
FIG. 8 is a photograph of the individual on the apparatus making contact with the ball.

The apparatus 20 further facilitates proper positioning of the individual's 90 body during the point at which the racket makes contact with the ball during the service motion, as depicted in FIGS. 7 and 8. In this respect, the apparatus 20 enables the heels of the individual 90 to selectively twist and contort, thus enabling the individual's hips to selectively rotate and ultimately arch the back of the individual in anticipation of and in hitting the ball. Advantageously, unlike prior art teaching instruction on solid ground that does not facilitate proper body rotation, the apparatus 20 of the present invention enables the body to make the necessary rotational movements which are inherent in proper service motion. In this regard, Applicants have discovered that a "figure 8" pattern of movement of the hips is inherent in the service motion, as well as virtually all other types of tennis motions, whether it be a forehand, backhand, volley or overhead shot. For example, holding a tennis racquet and rotating both feet on the first and second platform surfaces 50, 60 in the same direction and then rotating both feet in the opposite direction promotes the individual to wave the racquet in a "figure 8" formation while the hips move in such a "figure 8" formation.

Figure 9:
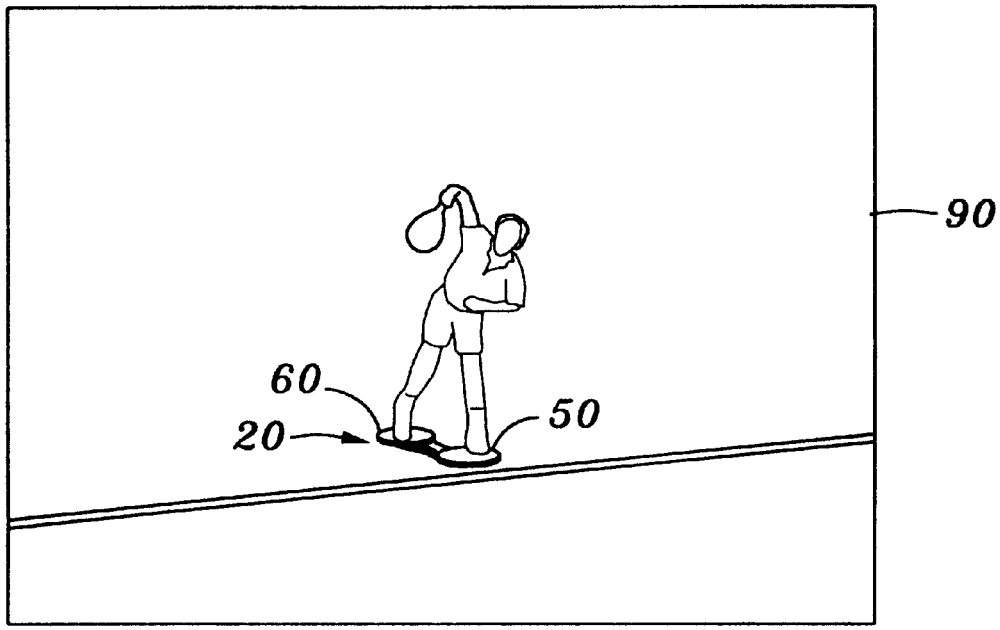
FIG. 9 is a photograph of the individual on the apparatus following through with the service motion.
Figure 10:
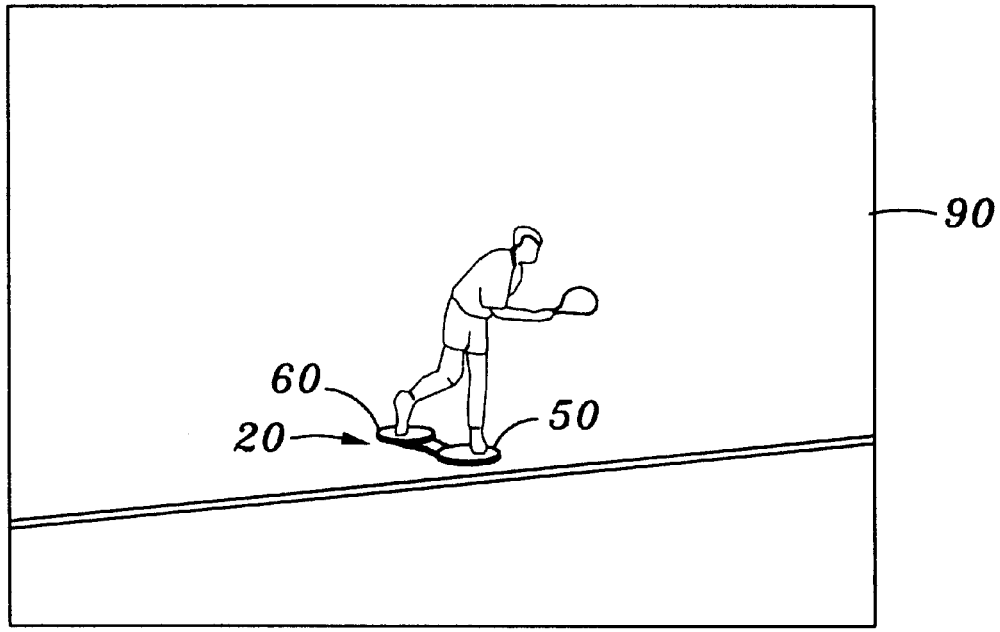
FIG. 10 is a photograph of the individual on the apparatus completing the service motion.

With regard to the remaining motions of service, there is depicted in FIGS. 9 and 10 the follow-through movements made by the individual 90 via use of the apparatus 20 of the present invention. As illustrated, by virtue of the individual 90 standing upon the rotating platform surfaces 50, 60, the individual is able to complete a rotational twist of the body necessary for proper follow-through. Practicing on solid ground, in contrast, does not readily afford an individual to engage in such rotational movement, much less rotational movement of the hips and the "figure 8" manner described above. Accordingly, the apparatus 20 facilitates proper movement and enables an individual to readily realize the motions necessary to make proper service.

The apparatus 20 may further be utilized in a similar manner in practicing forehand, backhand, and volley shots as well. In this respect, an individual standing upon the apparatus 20 in the aforementioned manner can be "fed" shots from an instructor or ball machine such that an individual is allowed to make such shots while standing upon the apparatus 20. While standing upon the apparatus 20, the individual is able to easily make the rotational movements necessary to not only anticipate making a given shot, but also make the motions necessary to hit the ball in the desired manner. Accordingly, it is contemplated that the apparatus 20, as utilized by an individual for practicing various tennis strokes, can be incorporated as an ongoing means of instruction, training and the like. To that end, it is contemplated that the methods of performing the various motions discussed herein can be incorporated as part as live instruction, television, and/or recorded video tape to thus generate information regarding a given individual's motions to thus correct or improve the same, particularly with respect to improving the balance and coordination necessary to make such movements.

For example, in using the apparatus 20 for training purposes, the apparatus 20 may first be placed in a center position of the tennis court. The individual may then engage both the first and second planar surfaces 50, 60 with the respective feet in a parallel fashion. Preferably, the knees should then be slightly bent to facilitate proper movement and rotation on the apparatus 20. The individual should then hold the tennis racquet upwards in approximately a 45 degree angle. To get accustomed to the feel of the apparatus 20, the individual should then rotate both feet on the surfaces 50, 60 in the same direction, e.g. clockwise, and then rotate both feet in the opposite direction, e.g. counter-clockwise. At the same time, the individual should then naturally wave the tennis racquet in a "figure 8" formation while holding the racquet upwards in a 45 degree angle. Thus, when a ball is thrown at the individual standing on the apparatus 20, the individual may easily swing the racquet and contact the ball with the proper body rotation and movement as facilitated by the apparatus 20. The aforementioned positioning of the apparatus 20 also allows the individual to practice serves as shown in FIGS. 3–10.

Advantageously, the positioning of the apparatus 20 may be varied to assist the individual in training for specific types of tennis swings. To practice a forehand swing, the apparatus 20 may be placed in a forehand position at approximately a positive 45 degree angle measured from the center of the court such that when the individual stands upon the apparatus 20, the individual is facing one of the poles which holds the tennis court net. Specifically, if the individual is right-handed, the individual would be facing the right-most tennis court pole. The aforementioned process of rotating on the apparatus 20 may then be employed to practice the forehand. Similarly, the apparatus 20 may assist in training an individual's backhand swing by placing the apparatus 20 in a backhand position in approximately a negative 45 degree angle such that the individual faces one of the poles holding the tennis court net. If the individual is right-handed, the individual would be facing the left-most tennis court pole. Once again, the individual may practice the backhand as previously described. Even further, the apparatus 20 may be positioned in close proximity to the tennis court net in either the center position, forehand position, or backhand position to assist the individual in close range volleying shots.

Optionally, an incline board may be placed beneath the apparatus 20 to further stabilize the apparatus 20. In this respect, the incline board maybe formed as a triangular wedge having an incline of approximately a 45 degrees. Optionally, the incline board may be placed beneath the apparatus 20 in the center position, forehand position, or backhand position. While the previously described positions are advantageous in training for specific types of tennis swings, the apparatus 20 may be placed in any position the individual desires to accommodate the individual's specific type of training.

Figure 11:
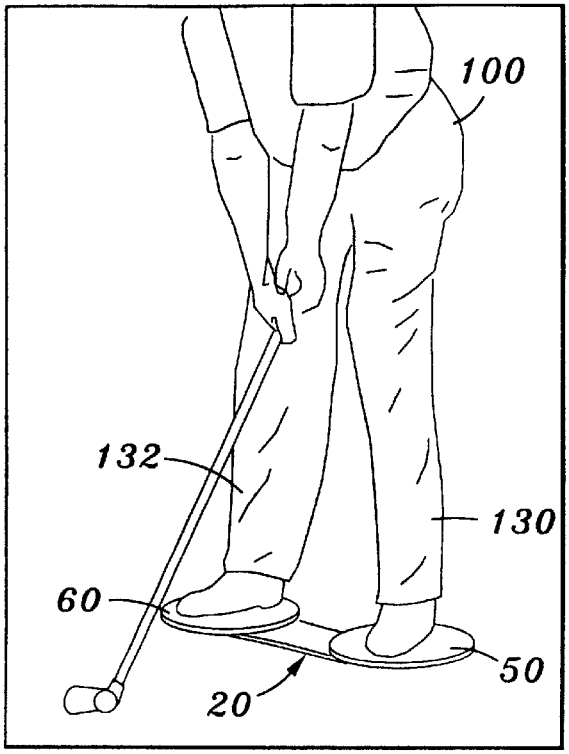
FIG. 11 is a photograph of an individual standing upon the apparatus depicted in FIG. 1 prior to initiating the swing of a golf club.
Figure 12:
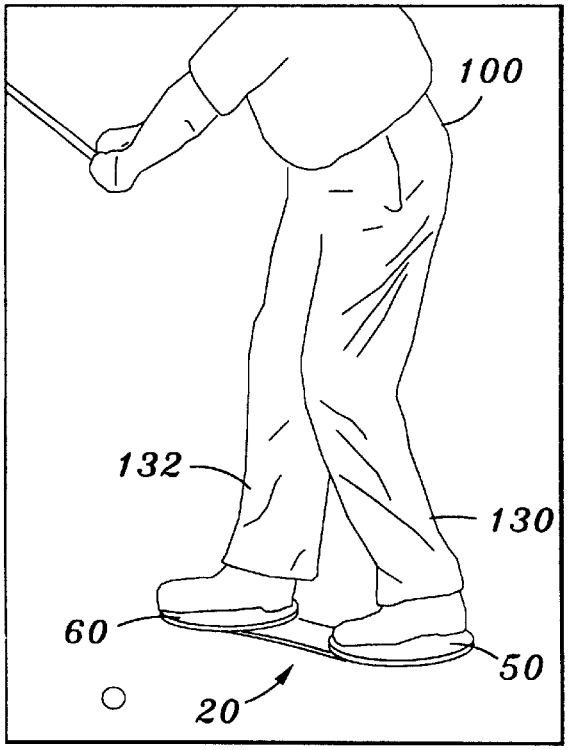
FIG. 12 is a photograph of the individual initiating the swing of the golf club and rotating the apparatus.
Figure 13:
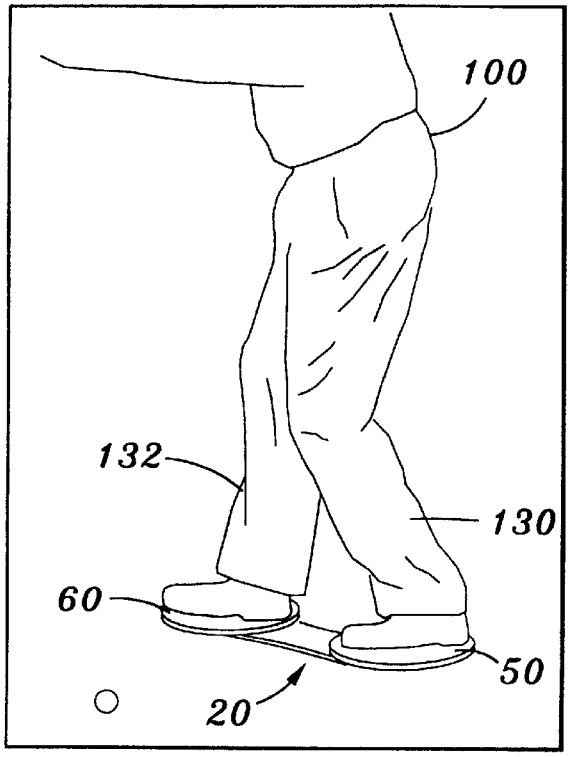
FIG. 13 is a photograph of the individual holding the golf club at the peak of the swing.

Referring now to FIGS. 11–19, there is shown use of the apparatus 20 by a golfer 100 to improve upon the golfer's swing. As illustrated in FIG. 11, the individual 100 is shown standing upon the apparatus 20 such that one foot is received upon the first rotational platform 50 and the other foot is received upon the second rotational platform 60 with the golf club 120 fully retracted prior to swinging. As illustrated in FIG. 12, the rotational movement of the platform surfaces 50, 60 can enable the feet 130, 132 of the golfer to freely and independently rotate about separate axes to thus enable the individual to perform the necessary movements inherent in an ideal golf swing.

As to the back swing depicted in FIGS. 11 and 12, there is shown the ability of the apparatus 20 to accommodate a greater degree of rotational movement of the golfer's left leg and foot 130 relative the right leg and foot 132. As is well-known, such rotational movement, particularly with respect to the hips, can impart to an individual 100 the ideal position and movement by which the golf stroke can be made. To that end, such leg and hip rotational movement is clearly depicted in FIG. 13 which shows the greater degree of inward rotational movement of the left foot 130, relative to the right foot 132, prior to striking the ball.

Figure 14:
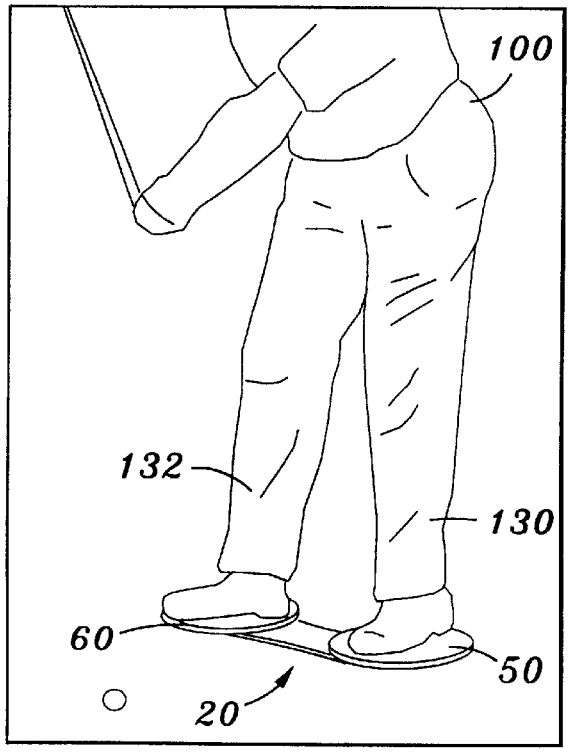
FIG. 14 is a photograph of the individual swinging the golf club toward the ball while changing the direction of rotation.
Figure 15:
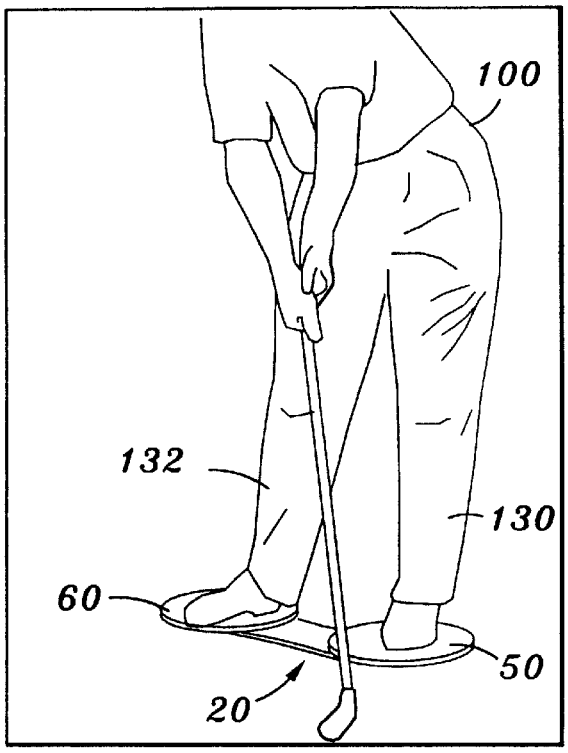
FIG. 15 is a photograph of the individual on the apparatus following through the golf swing and making contact with the golf ball.
Figure 16:
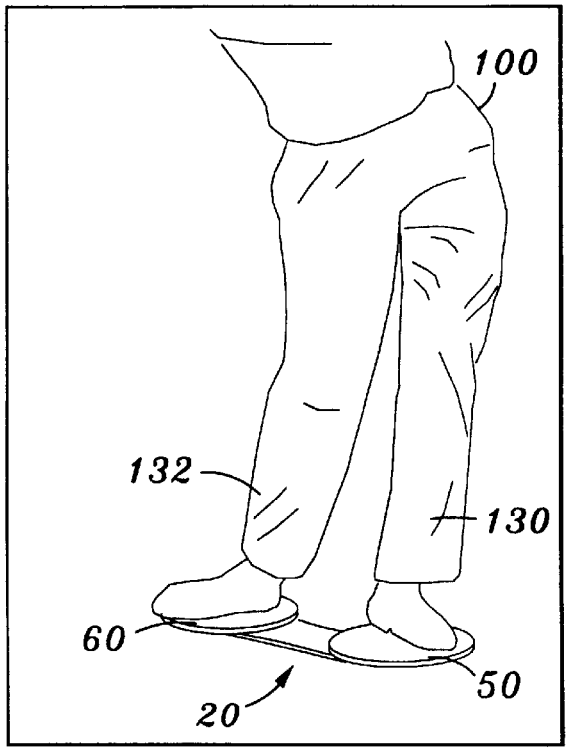
FIG. 16 is a photograph of the individual following through the golf swing after hitting the golf ball.

The rotational movement imparted by the rotating platform surfaces 50, 60 of the apparatus 20 further facilitates proper golf swing during contact with the ball, as shown in FIG. 15. As shown, the individual's feet 130, 132 are free to rotate, which thus enables a greater degree of rotational movement by the hips of the golfer. Indeed, as shown in FIGS. 14 and 15, the individual 100 is able to follow-through with his hip placement being substantially parallel with that of the ball, as opposed to the exaggerated manner provided by the apparatus 20 during the back swing motion. In this respect, substantial contrast can be seen between the position of the hips of the golfer 100 in FIG. 16, as opposed to FIGS. 11 and 12. Such exaggerated movement enables the golfer 100 to assume such positions in order to learn the proper mechanics of striking a ball, and has been shown to substantially improve a golfer's balance, as well as properly coordinate a golfer's body during such movements. Additionally, the apparatus 20, when utilized for such golf stroke applications, can be helpful in identifying and improving a portion or portions of a golfer's swing that is uncoordinated and improperly made.

Figure 17:
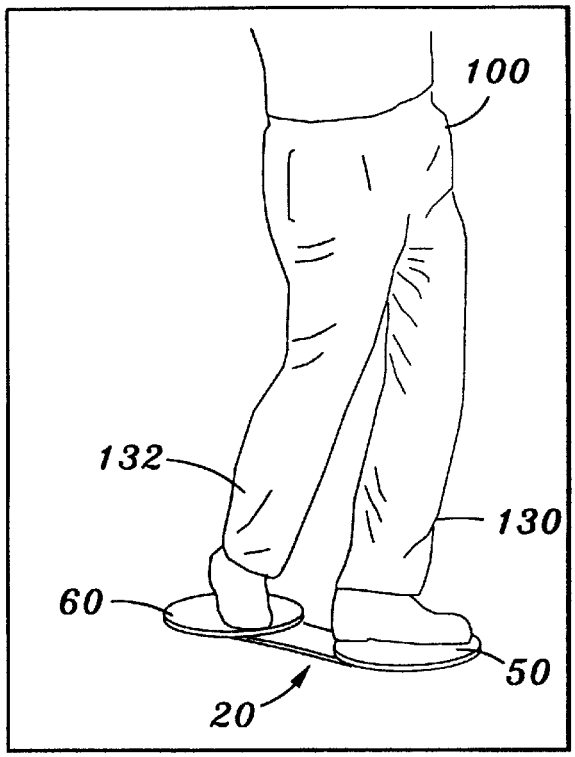
FIG. 17 is a photograph of the individual further rotating the apparatus and following through the golf swing.
Figure 18:
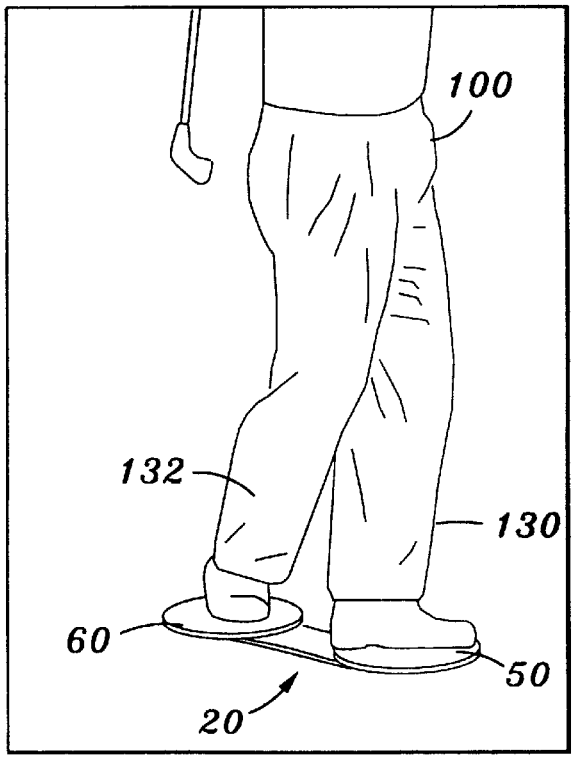
FIG. 18 is a photograph of the individual completing the golf swing.

The same benefits are further achieved as the golfer 100 completes the swing motion, as depicted in FIGS. 17–18. As shown, the golfer 100 is able to freely rotate his body in completing the golf swing by virtue of the rotational movement imparted by the first and second platform surfaces 50, 60. As shown, the feet 130, 132 of the individual 100, especially the left foot 130 thereof, are able to move approximately 180° during the golf swing motion. Advantageously, such movement, relative the stationary golf ball, greatly enhances the golfer's ability to make a proper golf swing motion, which, over time, ultimately produces an ideal golf swing.

As will be readily appreciated, the sports of tennis and golf are but two of a wide variety of uses for the apparatus 20 of the present invention with respect to sports instruction. Along these lines, it is contemplated that the apparatus 20 may be utilized to promote ideal rotational body movement as preferred in the swinging of a bat or releasing a bowling ball. The apparatus further has widespread applicability in sports that necessarily require balance and coordination, as well as a high degree of rotational movement. Along these lines, it is contemplated that the apparatus 20 of the present invention can be readily incorporated into teaching methods associated with martial arts performance, skiing, surfing, and ice skating. It is further contemplated that such apparatus may be readily incorporated into a general fitness regimen, such as aerobics and the like, or simply as a means to exercise and facilitate rehabilitation. Accordingly, it is contemplated that a wide variety of applications can be utilized for the apparatus 20 of the present invention.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A process of improving a person's tennis stroke while holding a tennis racquet, the process comprising the steps of:

a) providing an apparatus, the apparatus comprising:
   i) a rigid, stationary base member positionable upon a planar surface;
   ii) a first platform surface rotatably mounted upon the base member, the first platform surface being formed to rotate about a first axis; and
   iii) a second platform surface rotatably mounted upon the base member, the second platform surface being formed to rotate about a second axis and extend along a continuous place relative said first platform surface;

b) placing said apparatus provided in step a) upon a tennis court;

c) placing each foot of a person on a respective one of the first and second platform surfaces of the apparatus positioned in step b);

d) advancing at least one tennis ball in close proximity to the person whose feet are placed upon the apparatus in step c); and e) having said person hit said tennis ball advanced in step d) by means of a tennis stroke selected from the group consisting of a forehand and a backhand while the hips of said person engage a figure 8 pattern of movement.

2. The process as recited in claim 1 wherein in step e) the tennis stroke is selected from the group consisting of a volley, and service motion.

3. The process of claim 1 wherein said process further comprises the step of: repeating steps a)–e).

4. A process of improving a person's balance and coordination, the process comprising the step of:

a) placing an apparatus on a planar surface, the apparatus comprising:
   i) a rigid stationary base member positionable upon the planar surface;
   ii) a first platform surface rotatably mounted upon the base member, the first platform surface being formed to rotate about a first axis; and
   iii) a second platform surface rotatably mounted upon the stationary base, the second platform surface being formed to rotate about a second axis and extend along a continuous plane relative said first platform surface;

b) placing each foot of the person on a respective one of the second and third platform surface; and c) performing a body movement, said body movement being selected from the group consisting of a tennis stroke, a golf swing, a swing of a baseball bat, a martial arts maneuver, an aerobics exercise, a surfing motion.

5. A process of improving a person's golf swing while holding a golf club, the process comprising the steps of:

a) providing an apparatus, the apparatus comprising:
   i) a rigid, stationary base member positionable upon a planar surface;

ii) a first platform surface rotatably mounted upon the base member, the first platform surface being formed to rotate about a first axis; and iii) a second platform surface rotatably mounted upon the base member, the second platform surface being formed to rotate about a second axis and extend along a continuous place relative said first platform surface;

b) placing said apparatus provided in step a) in a golf facility selected from the group consisting of a golf course and a golf driving range;

c) placing each foot of a person on a respective one of the first and second platform surfaces of the apparatus positioned in step b); and d) having said person hit a golf ball by means of a golf swing while the hips of said person engage a figure 8 pattern of movement.

6. The process of claim 5 wherein said process further comprises the step of repeating steps a)–e).

* * * * *